US010485334B2

(12) United States Patent
Yen et al.

(10) Patent No.: US 10,485,334 B2
(45) Date of Patent: Nov. 26, 2019

(54) MULTIFUNCTIONAL FOLDING TABLE

(71) Applicant: AMW INTERNATIONAL CO., LTD., Taipei (TW)

(72) Inventors: Ming-Hui Yen, Taipei (TW); Cheng-Chen Yang, Taipei (TW)

(73) Assignee: AMW INTERNATIONAL CO., LTD., Taipei (TW)

( * ) Notice: Subject to any disclaimer, the term of this patent is extended or adjusted under 35 U.S.C. 154(b) by 88 days.

(21) Appl. No.: 15/957,916

(22) Filed: Apr. 20, 2018

(65) Prior Publication Data

US 2019/0320791 A1 Oct. 24, 2019

(51) Int. Cl.

| | |
|---|---|
| ***A47B 5/04*** | (2006.01) |
| ***A47B 5/00*** | (2006.01) |
| ***A47B 5/06*** | (2006.01) |

(52) U.S. Cl.

CPC ..... *A47B 5/006* (2013.01); *A47B 5/04* (2013.01); *A47B 5/06* (2013.01)

(58) Field of Classification Search

CPC .. A47B 5/006; A47B 5/04; A47B 5/06; A47B 77/10; D06F 81/06; D06F 81/00; D06F 81/02

USPC ..... 38/137, 103, 104, 135, 139; 108/42, 37, 108/39, 47, 48, 134

See application file for complete search history.

(56) References Cited

U.S. PATENT DOCUMENTS

| | | | | | |
|---|---|---|---|---|---|
| 1,420,206 | A | * | 6/1922 | Milam | D06F 81/06 108/48 |
| 1,622,404 | A | * | 3/1927 | Todd | D06F 81/02 108/122 |
| 1,626,624 | A | * | 5/1927 | Morrison | D06F 81/02 108/121 |
| 1,760,552 | A | * | 5/1930 | Haugh | D06F 81/02 108/122 |
| 1,787,363 | A | * | 12/1930 | Fahnestock | A47B 5/06 108/115 |
| 1,842,493 | A | * | 1/1932 | Soete | D06F 81/003 108/93 |
| 1,859,361 | A | * | 5/1932 | Gothman | D06F 81/02 108/29 |
| 2,101,597 | A | * | 12/1937 | Rich | D06F 81/02 108/123 |
| 2,253,741 | A | * | 8/1941 | Wernli | D06F 81/06 108/40 |
| 2,313,135 | A | * | 3/1943 | Fay | D06F 81/08 38/137 |

(Continued)

FOREIGN PATENT DOCUMENTS

| | | | |
|---|---|---|---|
| CA | 2639580 | * | 3/2010 |
| DE | 102004021314 | * | 11/2005 |
| FR | 3027613 | * | 1/2016 |

*Primary Examiner* — Janet M Wilkens
(74) *Attorney, Agent, or Firm* — Leong C. Lei

(57) ABSTRACT

The multifunctional folding table includes a board member, a first support member, and a locking member. The board member is hinged with first support member. The first support member is joined to a wall surface. When the multifunctional folding table is unfolded, the board member is perpendicular to the first support member. A leg frame hinged to an end of the board member adjacent to the first support member rests against the floor. The locking member is disposed to a bottom side of the board member to reliably maintain and lock the board member's unfolded state.

16 Claims, 14 Drawing Sheets

(56) References Cited

U.S. PATENT DOCUMENTS

| | | | | | |
|---|---|---|---|---|---|
| 2,337,428 | A * | 12/1943 | Tietz | H01B 7/29 | 174/113 R |
| 2,486,642 | A * | 11/1949 | Gilbreath | D06F 81/08 | 38/104 |
| 2,756,524 | A * | 7/1956 | Kleinsorge | D06F 81/10 | 38/137 |
| 3,893,401 | A * | 7/1975 | Casey | D06F 81/02 | 108/129 |
| 4,480,556 | A * | 11/1984 | Wilson | D06F 81/06 | 108/48 |
| 7,310,899 | B1 * | 12/2007 | Costa | A47B 77/10 | 108/42 |
| 2014/0245646 | A1 * | 9/2014 | Glenn, Jr. | D06F 81/02 | 38/137 |

* cited by examiner

MULTIFUNCTIONAL FOLDING TABLE

BACKGROUND OF THE INVENTION

(a) Technical Field of the Invention

The present invention is generally related to multifunctional tables, and more particular to a foldable table that may be mounted in a tight space in the kitchen, dressing room, laundry room, garage, etc.

(b) Description of the Prior Art

A conventional ironing table may be a floor standing one or one that sits on the desk top. The difference mainly lies in the length of their stands. The stand usually involves a pair of foldable pin-joined legs underneath a board. The board lies flat on the unfolded legs so as to facilitate the ironing of fabrics. The legs may be folded so that the ironing table may be conveniently stored.

One of the legs is usually hinged to the board, and the other leg is pin-joined to the first leg. The second leg pivots on the joining pin and may be snapped into different slots beneath the board so as to alter the height of the ironing table.

To reliably support the board, a tight coupling between the pin-joined leg and the slot is devised and some effort has to be exerted in order to plug the pin-joined leg into the slot. For a floor standing ironing table, it is relatively heavier. A user has to hold the board in one hand, and use the other hand to adjust and plug the pin-joined leg, while the board rests on the hinged leg alone. This is an inconvenient process and it is not uncommon that the user gets his/her finger pinched.

SUMMARY OF THE INVENTION

Therefore, a novel multifunctional folding table is provided so as to obviate the shortcomings of the prior art. The multifunctional folding table includes a board member. The board member includes, on a bottom side, two first positioning elements arranged oppositely and in parallel along two lateral edges, respectively, two rails extended in parallel from a front end along a front section of the board member, a leg frame having a back edge hinged to a back end of the board member, a second positioning element disposed between the first positioning elements aligned with but at a distance from the rails, and a hydraulic telescoping rod has a second end hinged to the second positioning element. Each first positioning element has a front pin hole and a back pin hole.

The multifunctional folding table further includes a first support member having a flat piece for mounting on a wall surface, two first beams are extended oppositely in parallel toward a front direction, two second beams disposed below the first beams extended oppositely in parallel and slantwise upward, two third beams disposed between and aligned with the second beams having their second ends hinged to the leg frame, two fourth beams having their first ends hinged to the second ends of the third beams, respectively, a seat adjacent to the first ends of the fourth beams sitting across the fourth beams, and a sliding pole arranged moveably between the rails. The first, second, and third beams have a first end hinged to a front side of the flat piece, and the telescoping rod has its first end hinged to the seat.

The multifunctional folding table further includes a locking member disposed to the bottom side of the board member between the second positioning element and the rails with its frond end between the rails. The locking member provides a notch for locking the sliding pole.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 5 and FIG. 13, a multifunctional folding table 1 according an embodiment of the present invention includes a board member 10, a first support member 20, and a locking member 30.

Figure 1:
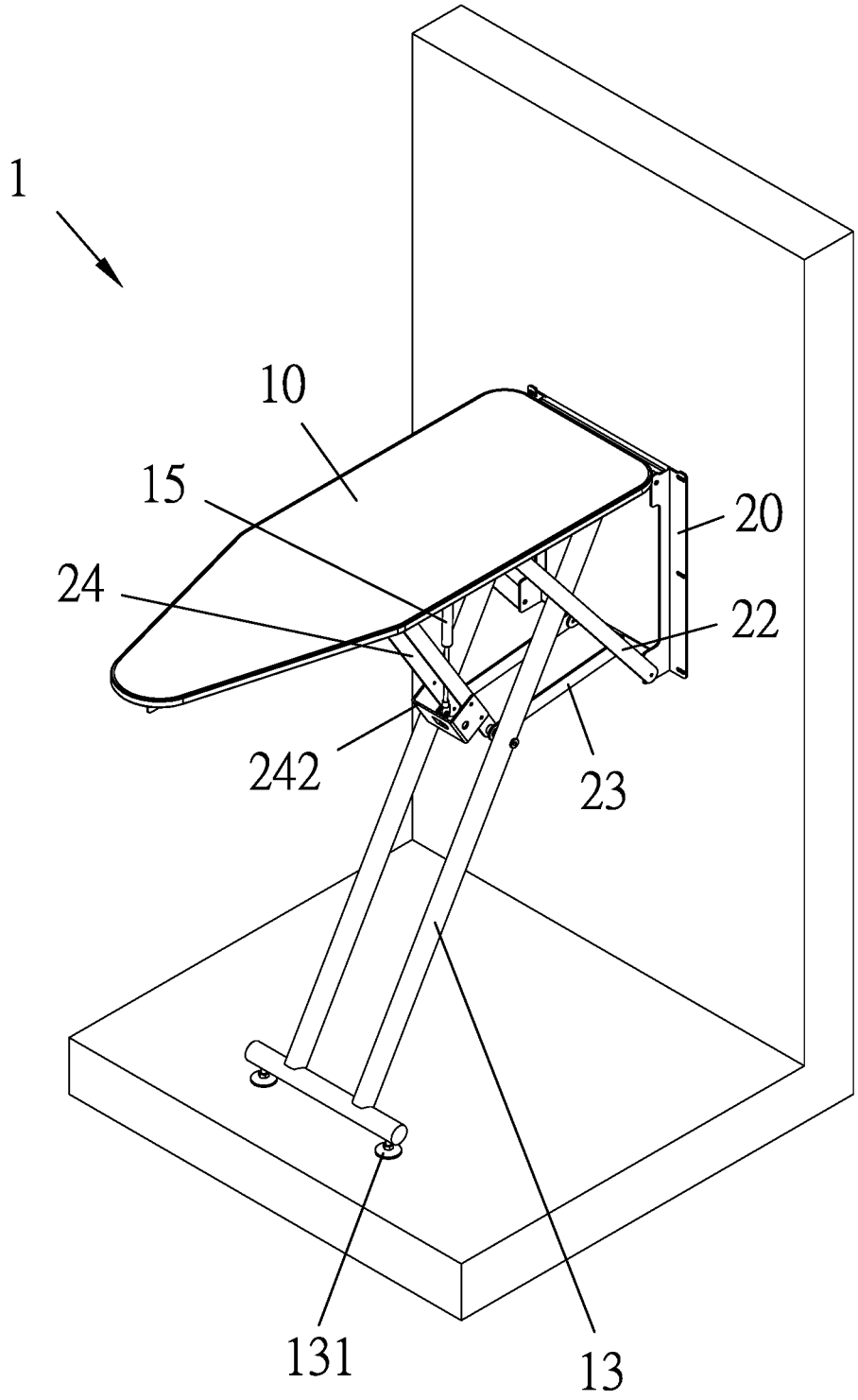
FIG. 1 is a perspective diagram showing a multifunctional folding table according to an embodiment of the present invention, unfolded and mounted to a wall.
Figure 2:
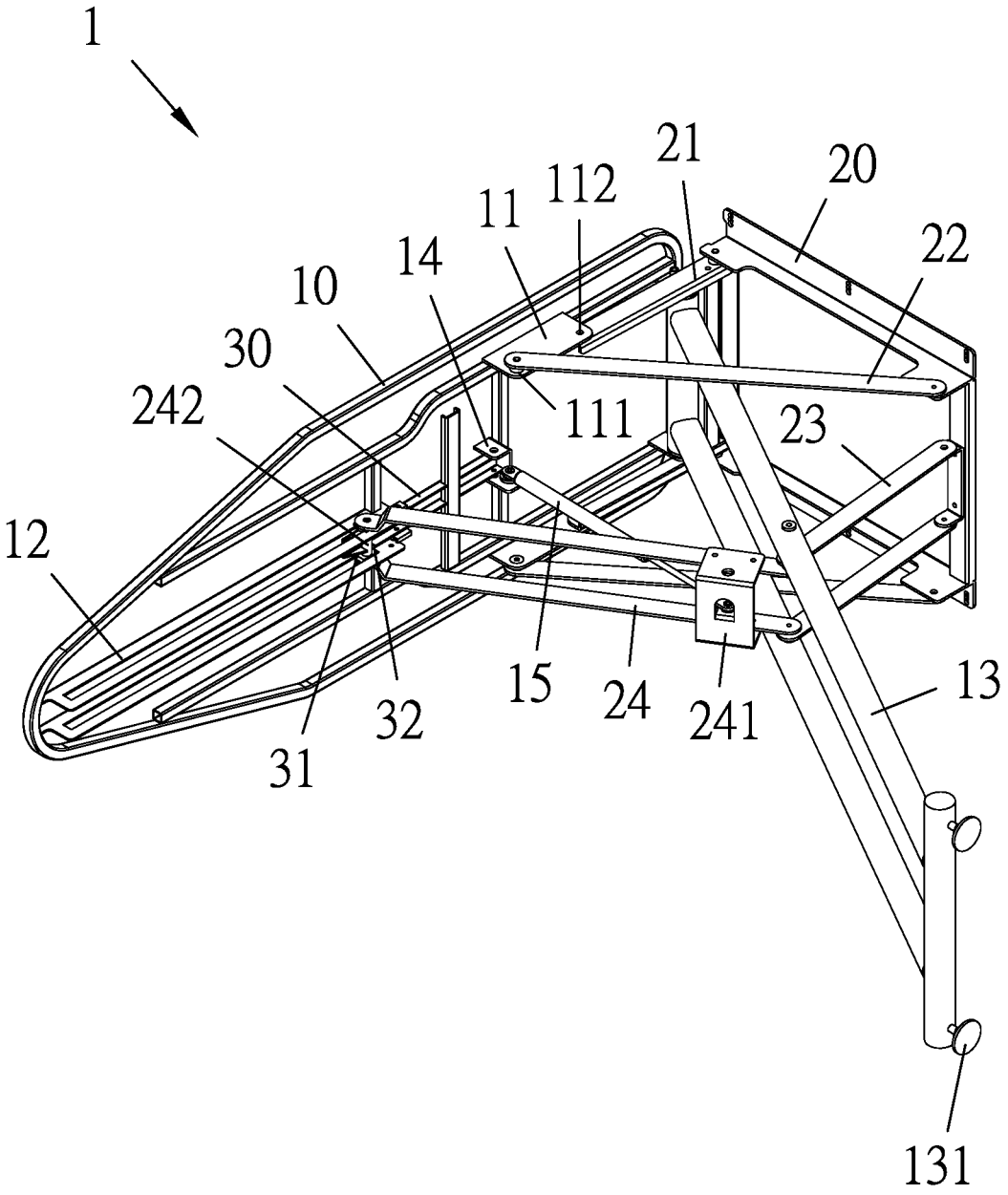
FIG. 2 is a perspective diagram showing the multifunctional folding table of FIG. 1 from another angle.
Figure 3:
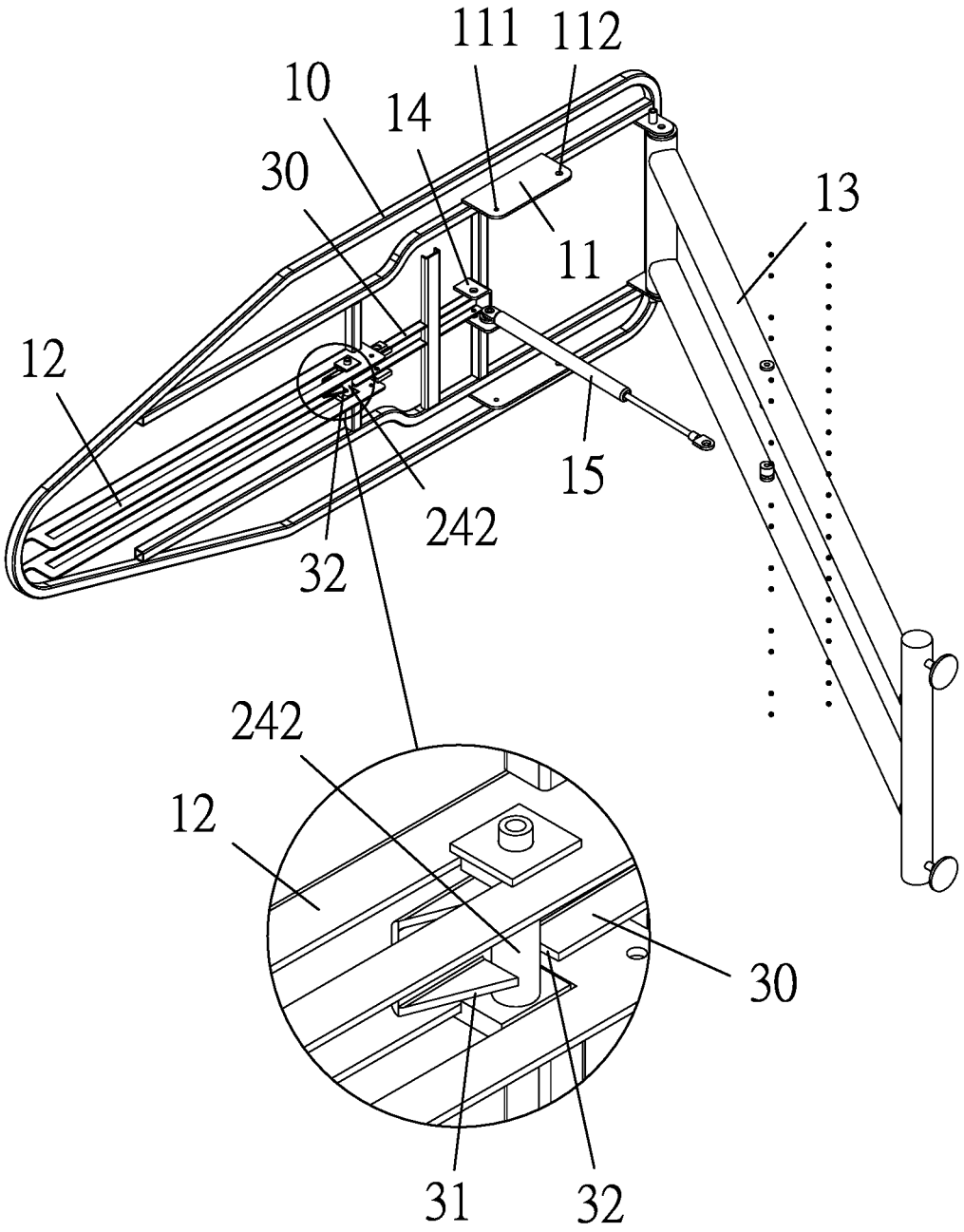
FIG. 3 provides partially enlarged detail to a locking member of the multifunctional folding table of FIG. 2.
Figure 4:
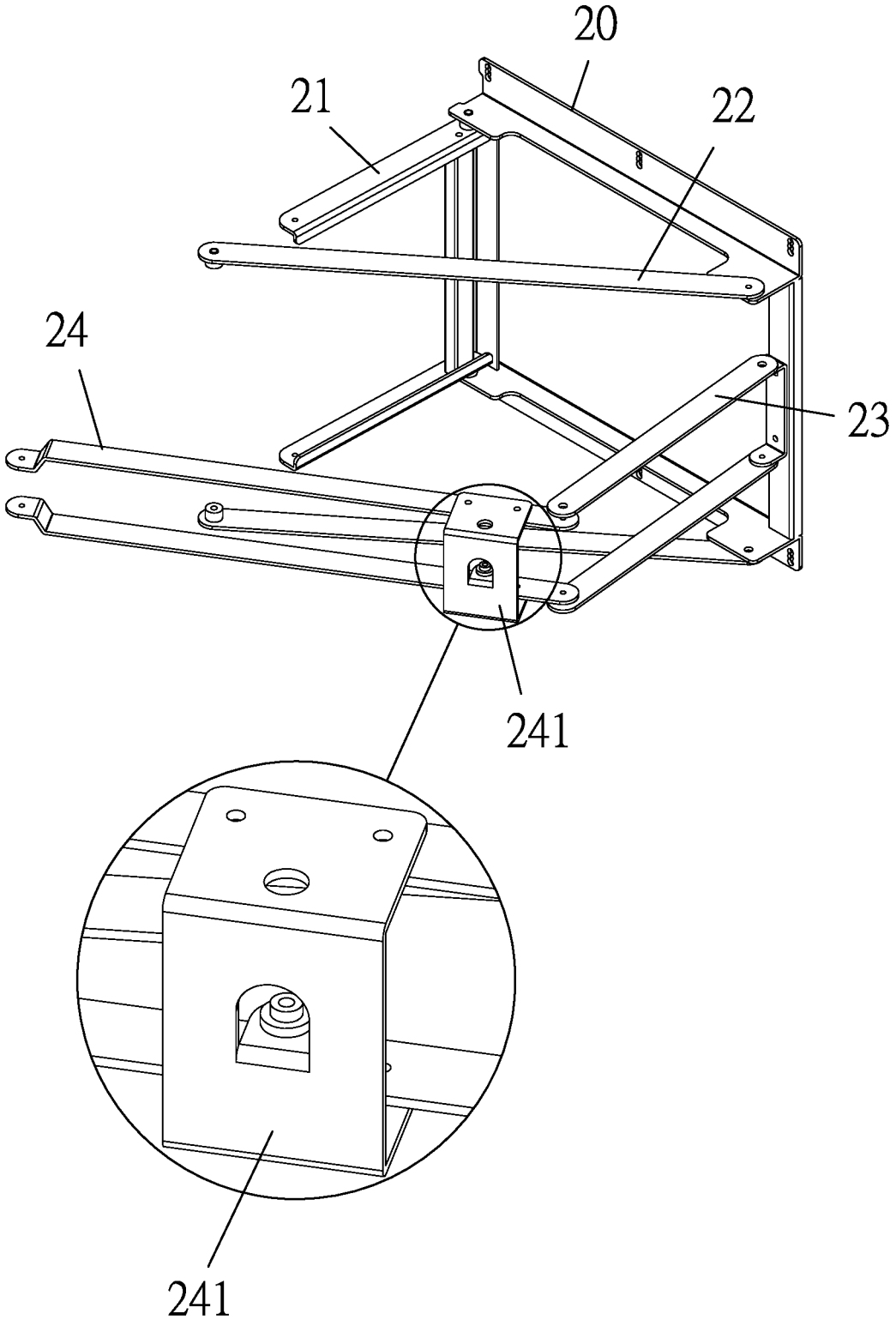
FIG. 4 provides partially enlarged detail to a first support member of the multifunctional folding table of FIG. 2.
Figure 5:
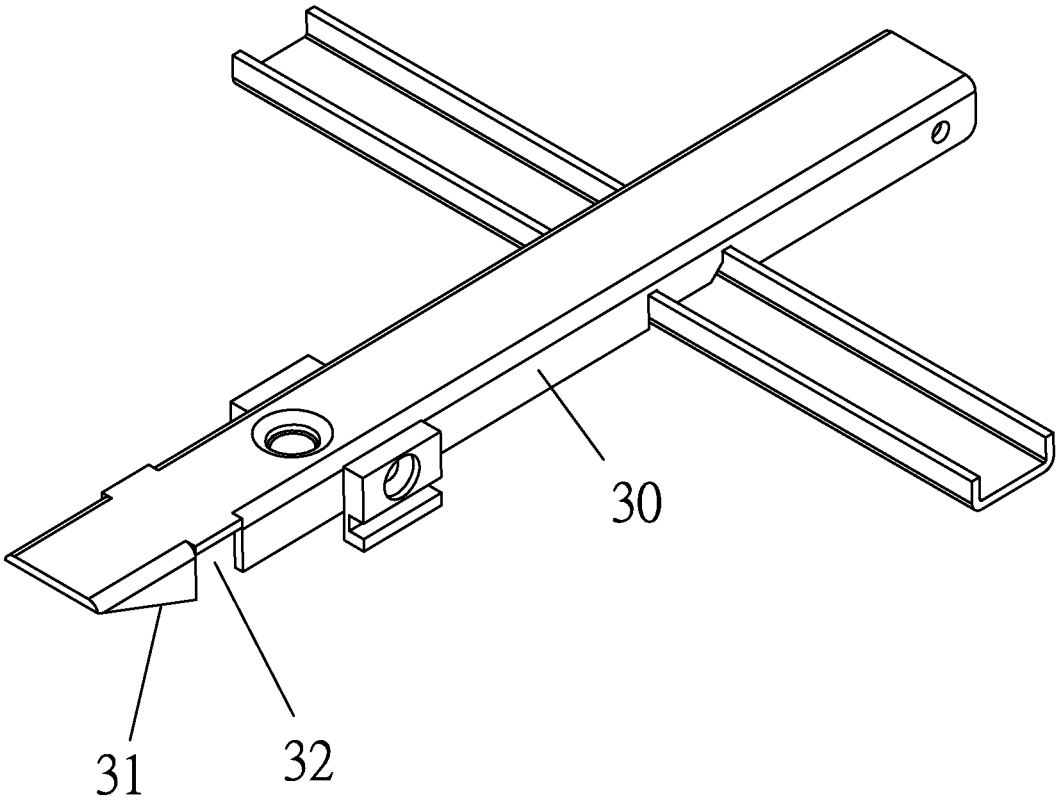
FIG. 5 is a perspective diagram showing the locking member of the multifunctional folding table of FIG. 2 from another angle.

As shown in FIGS. 1 to 3, the board member 10 has a rounded front end and a width of the board member gradually increases from the front end towards a middle section of the board member 10.

On a bottom side of the board member 10, there are two first positioning elements 11 arranged oppositely and in parallel along two lateral edges, respectively, and two rails 12 extended in parallel from the rounded front end along a front section of the board member 10. Each first positioning element 11 has a front pin hole 111 and a back pin hole 112. There is also a planar leg frame 13 having a back edge hinged to a back end of the board member 10. At least an adjustable stand 131 is provided along a front edge of the leg frame 13. There is also a second positioning element 14 disposed between the first positioning elements 11, aligned with but at a distance from the rails 12. A hydraulic telescoping rod 15 has a second end hinged to the second positioning element 14.

As shown in FIGS. 1 to 4, the first support member 20 includes a flat piece for mounting on a wall surface. All having a first end hinged to a front side of the flat piece, two first beams 21 are extended oppositely in parallel toward a front direction, and two second beams 22 are disposed below the first beams 21 extended oppositely in parallel and slantwise upward. The second beams 22 are longer than the first beams 21.

There are also two third beams 23, also having a first end hinged to the back side of the flat piece, are disposed between and aligned with the second beams 22. The third beams 23 have their second ends hinged to the leg frame 13, and the first ends of another two fourth beams 24, respectively. Adjacent to the first ends of the fourth beams 24, a seat 241 sits across the fourth beams 24. The telescoping rod 15 has its first end hinged to the seat 241. The fourth beams 24 have their second ends hinged to two ends of a sliding pole 242, which is arranged moveably between the rails 12.

The first, second, third, and fourth beams 21, 22, 23, and 24 are all arranged at intervals and in parallel.

As shown in FIGS. 1 to 8, the locking member 30 is disposed to the bottom side of the board member 10 between the second positioning element 14 and the rails 12 with its frond end between the rails 12. The front end of the locking member 30 provides a ramp 31 and a notch 32 behind the ramp 31. The sliding pole 242 may slide across the ramp 31 and embed into the notch 32, thereby being locked by the locking member 30.

Figure 6:
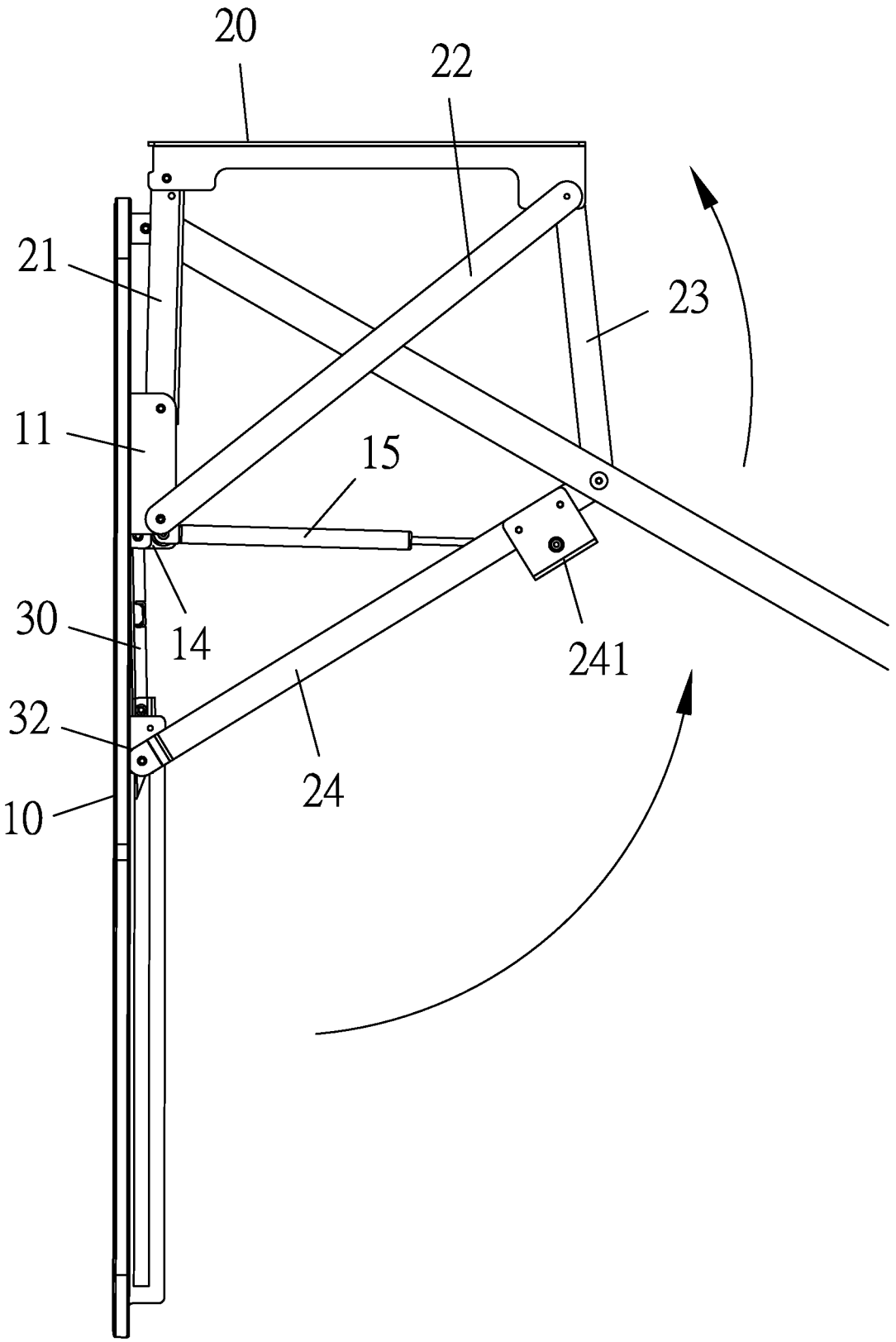
FIG. 6 is a profile diagram showing the multifunctional folding table of FIG. 1 being unfolded.
Figure 7:
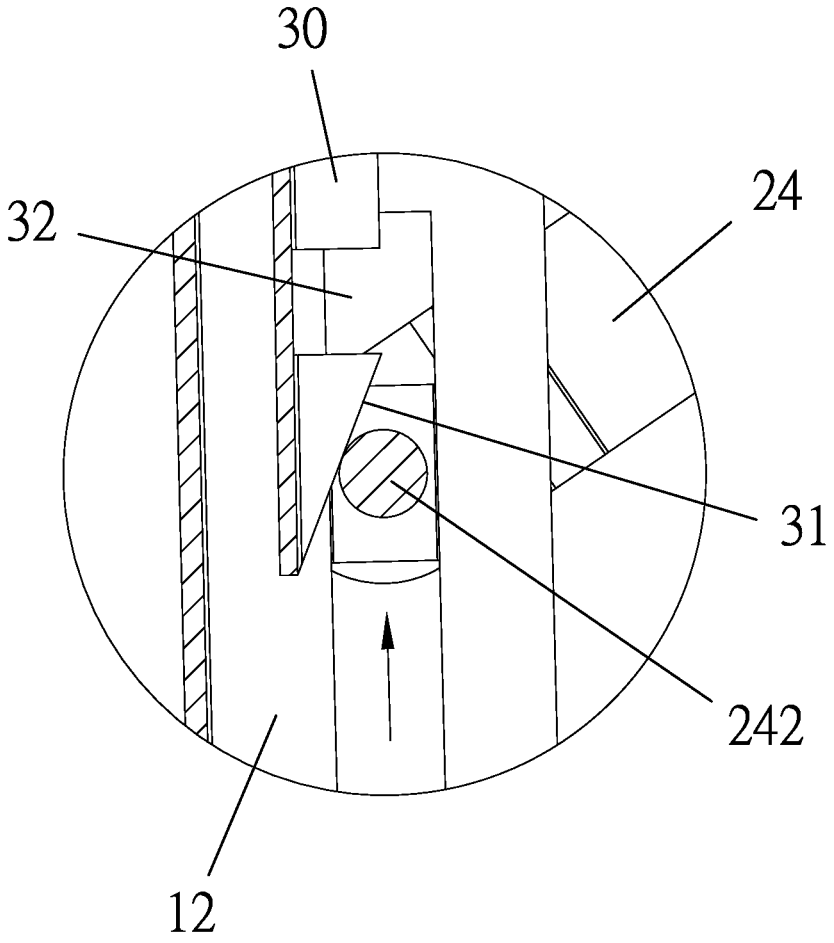
FIG. 7 is a profile diagram showing a state of the locking member as the multifunctional folding table of FIG. 1 is unfolded.
Figure 8:
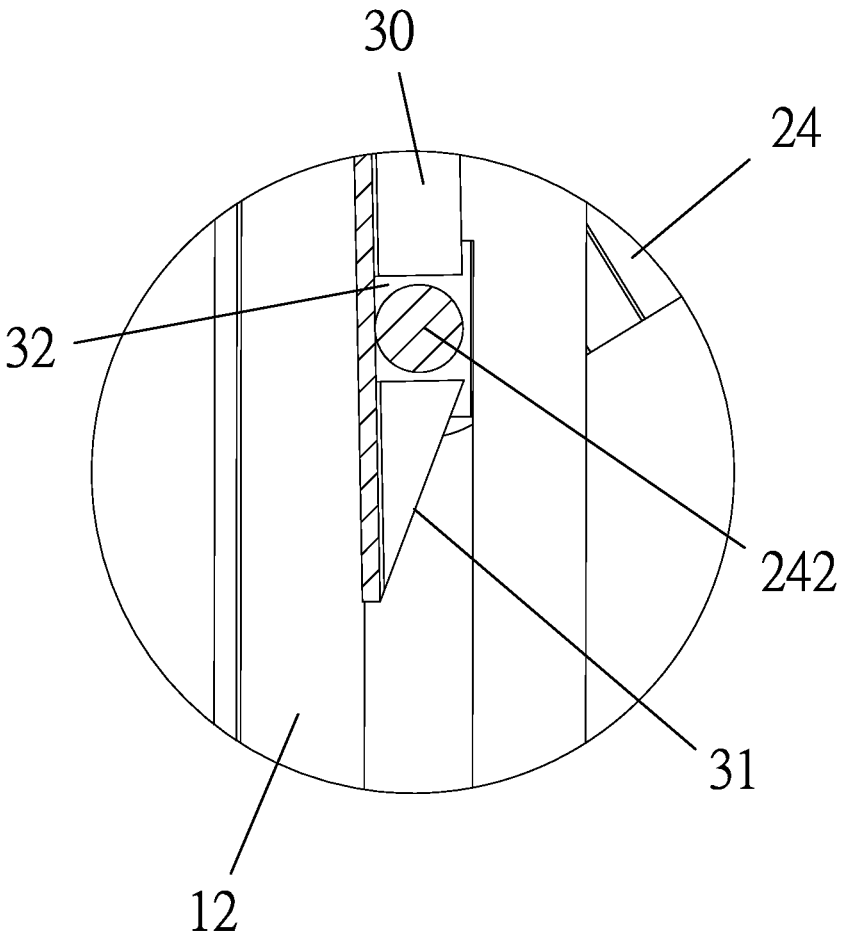
FIG. 8 is a profile diagram showing another state of the locking member as the multifunctional folding table of FIG. 1 is fully unfolded.

As shown in FIGS. 6 and 8, when the multifunctional folding table 1 is fully unfolded, the board member 10 and the first support member 20 become perpendicular to each other, and the sliding pole 242 is moved across the ramp 31 and locked inside the notch 32 of the locking member 30. The telescoping rod 15 extends as leg frame 13 is turned downward so that its front edge rests on the floor. When the multifunctional folding table 1 is fully unfolded, the telescoping rod 15 would be perpendicular to the board member 10 and the first beams 21.

Figure 9:
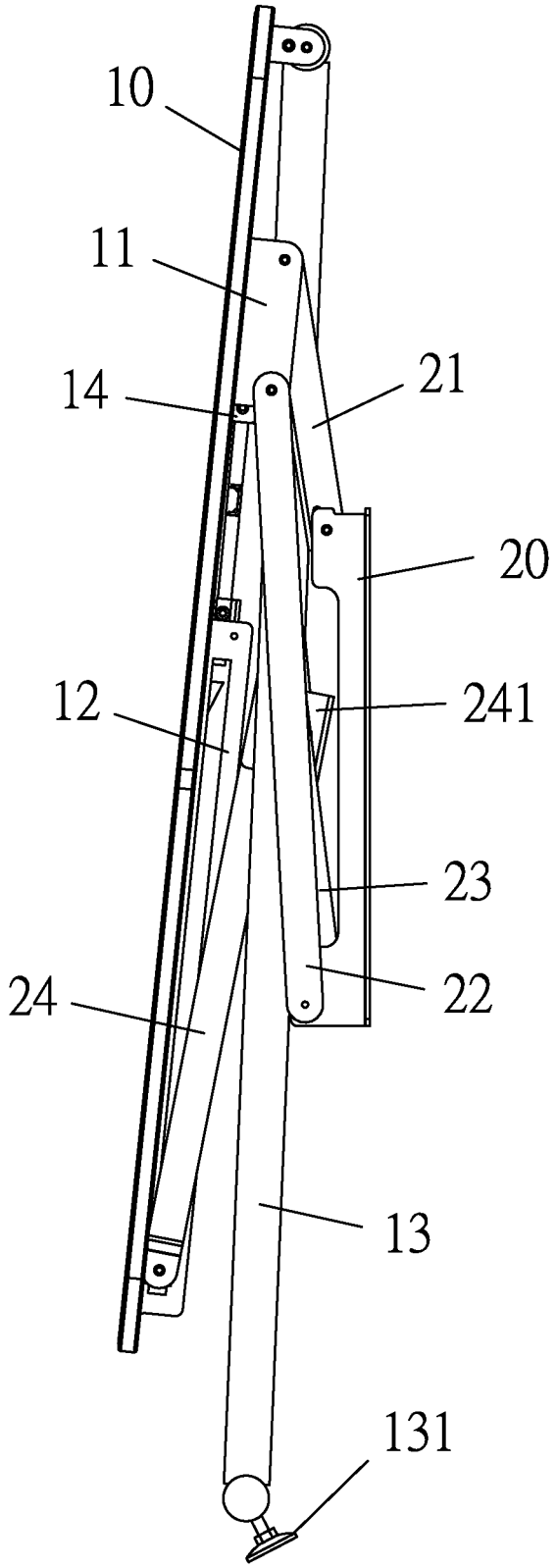
FIG. 9 is a profile diagram showing the multifunctional folding table of FIG. 1 being fully folded.
Figure 10:
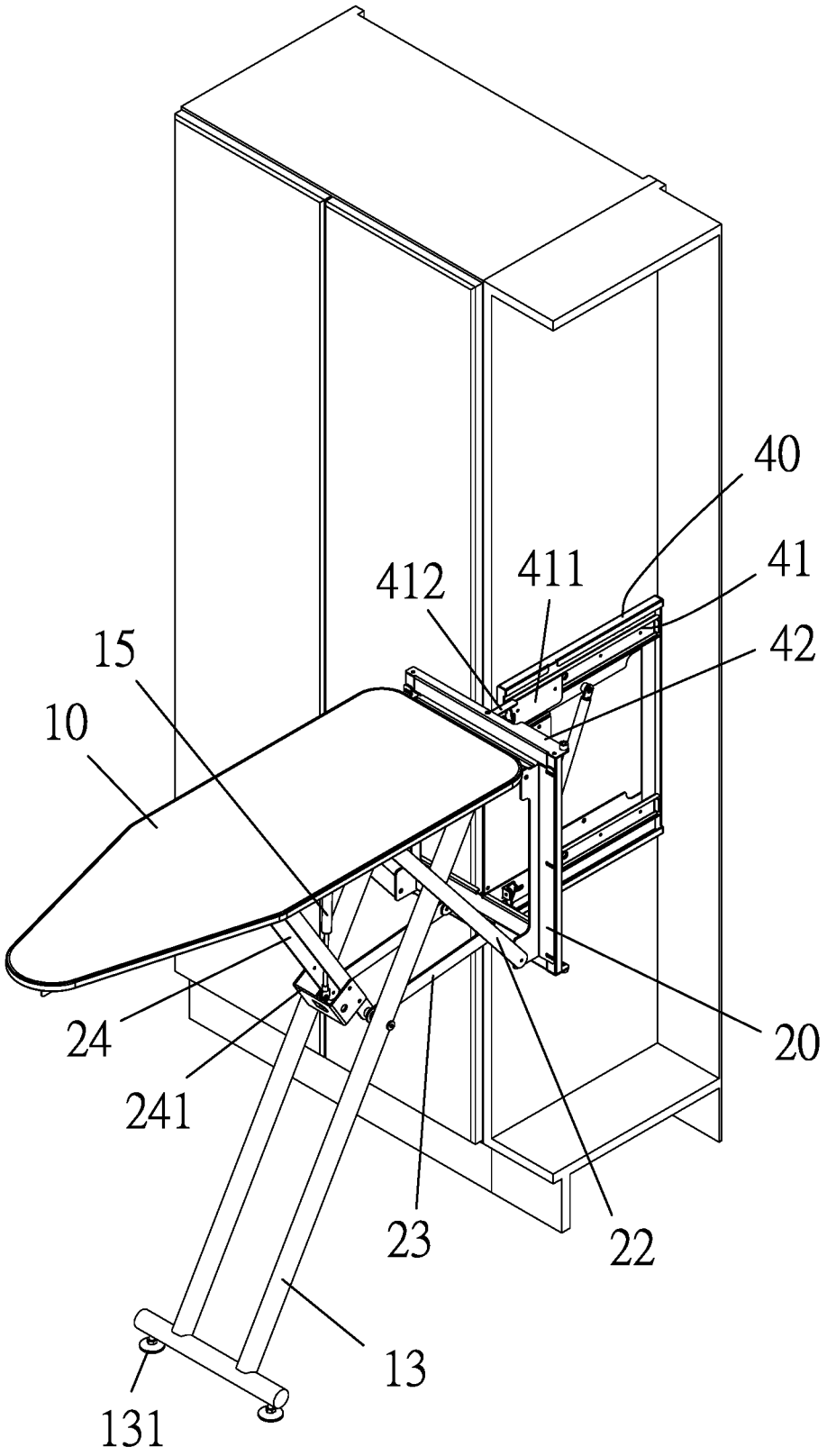
FIG. 10 is a perspective diagram showing a multifunctional folding table according to another embodiment of the present invention, unfolded and mounted to a side of a closet.
Figure 11:
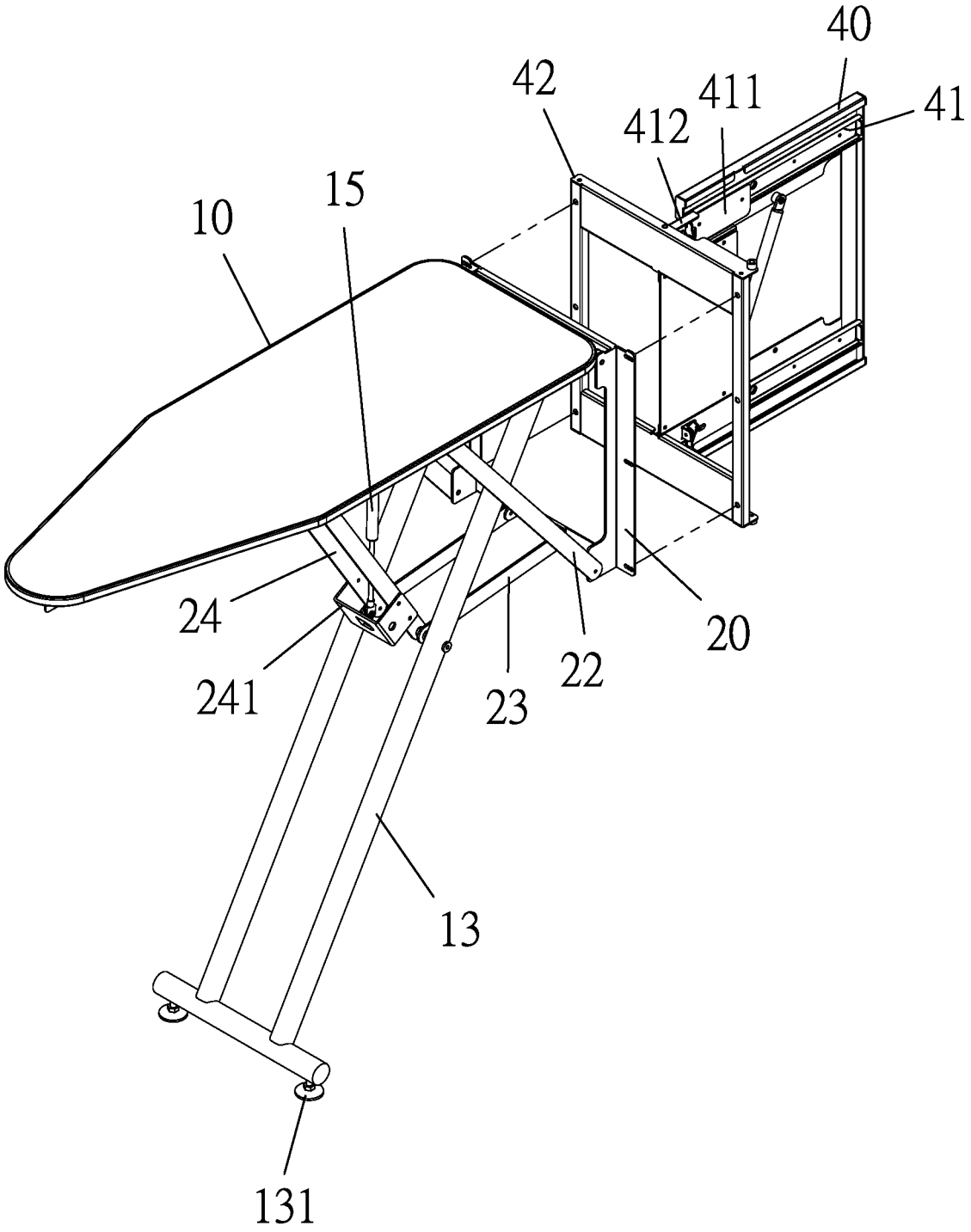
FIG. 11 is a perspective diagram showing the multifunctional folding table of FIG. 10.
Figure 12:
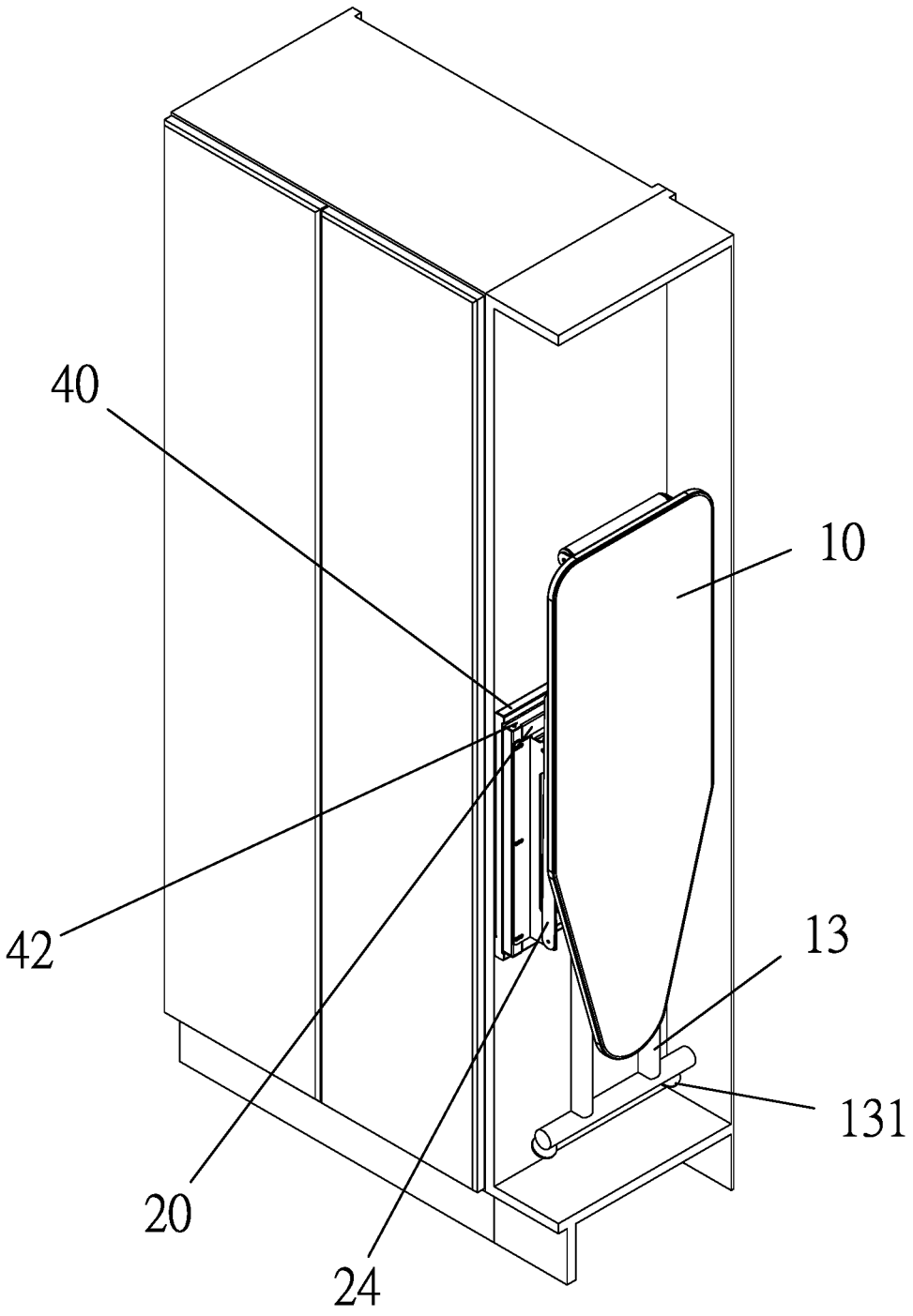
FIG. 12 is a perspective diagram showing the multifunctional folding table of FIG. 10 being fully folded.
Figure 13:
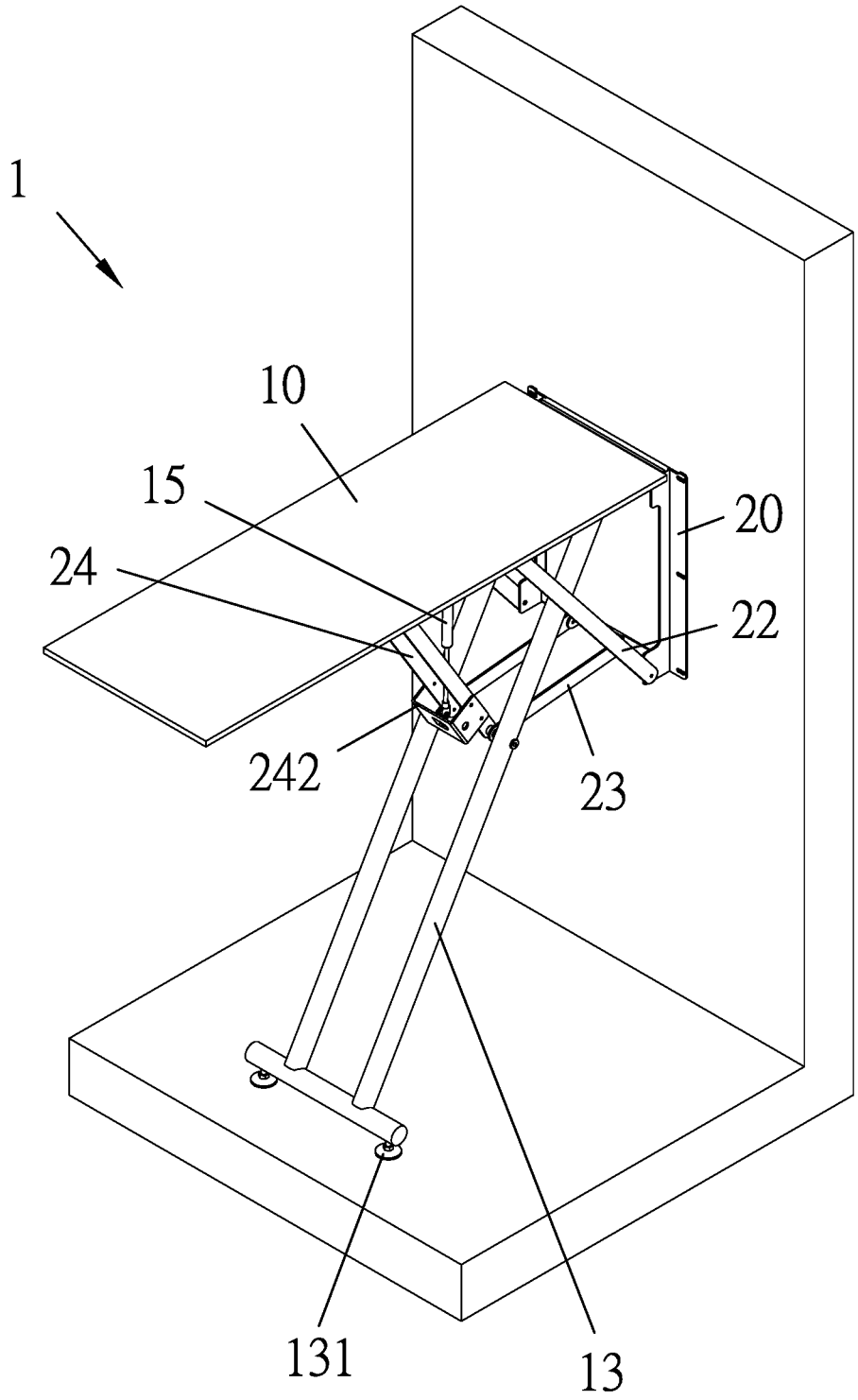
FIG. 13 is a perspective diagram showing the multifunctional folding table of FIG. 1 with a rectangular board member.
Figure 14:
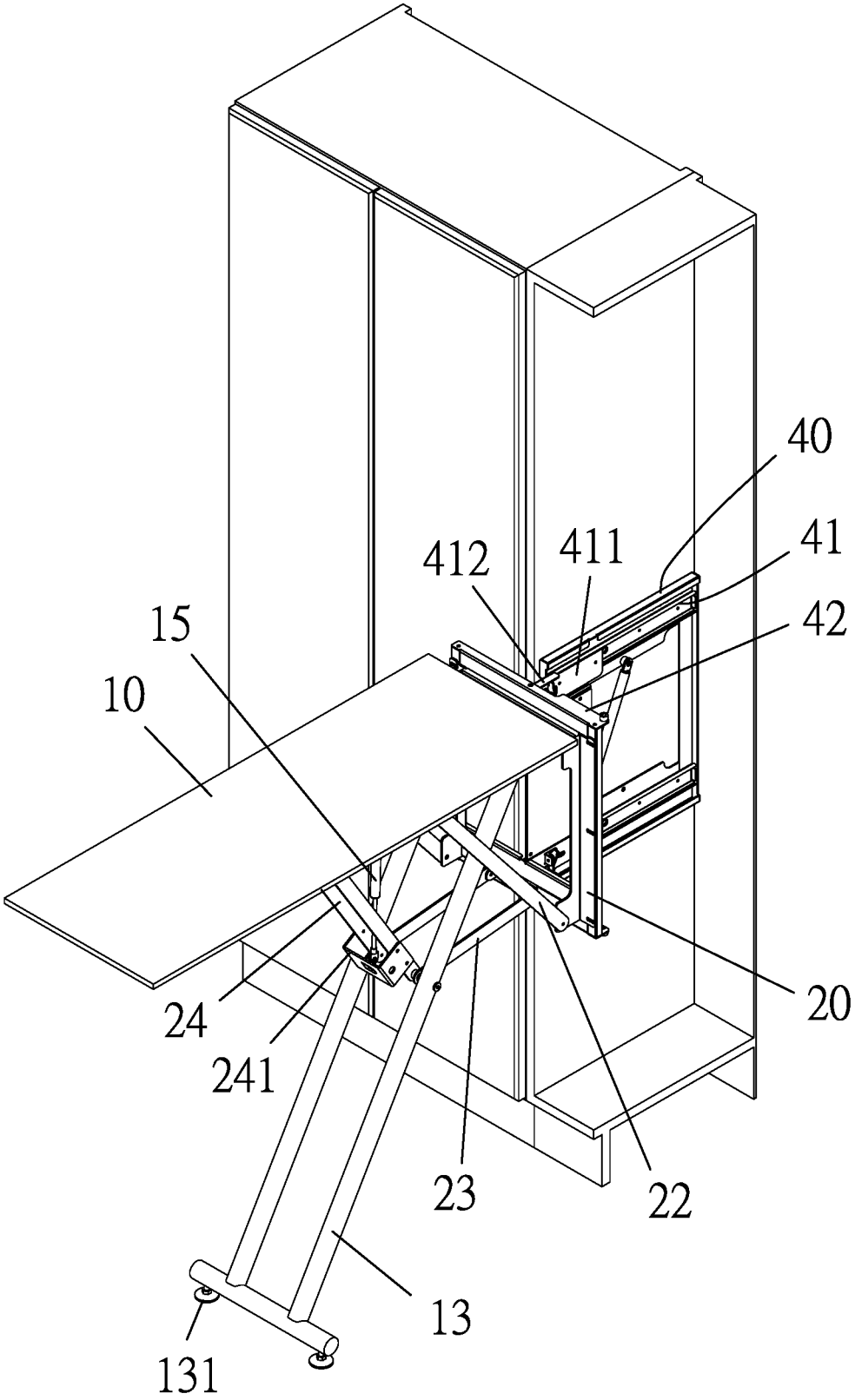
FIG. 14 is a perspective diagram showing the multifunctional folding table of FIG. 10 with a rectangular board member.

As shown in FIG. 9, the multifunctional folding table 1 is folded by reversing the above process so that the board member 1 is tightly attached to the leg frame 13, thereby reducing the table 1's occupied space for convenient storage.

FIGS. 10 to 12, and FIG. 14 provide a multifunctional folding table according to another embodiment of the present invention. Description to the components identical to the previous embodiment is omitted.

In the present embodiment, the multifunctional folding table further includes a second support member 40. The second support member 40 includes a flat piece for mounting on a wall surface. On a side of the flat piece opposite to the wall surface, two sliding rails 41 are extended oppositely in parallel toward a front direction, and each sliding rail 41 is moveably configured with a sliding element 412. The sliding elements 412 are hinged to a middle spot along a top edge and a bottom edge of a frame 42, respectively. A front side of the frame 42 is joined to a back side of the flat piece of the first support member 20. To unfold the multifunctional folding table, the frame 42 is pulled and turned towards the front, and the first and second support members 20 and 40 are perpendicular to each other. To fold the multifunctional folding table, the frame 42 is turned towards the second support member 40 and, through the sliding elements 411, the frame 42 may be pushed backward. The first and second members 20 and 40 become parallel to each other. The multifunctional folding table therefore may be stored in a tight and narrow space for enhanced space utilization.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A multifunctional folding table, comprising:

a board member comprising, on a bottom side, two first positioning elements arranged oppositely and in parallel along two lateral edges, respectively, two rails extended in parallel from a front end along a front section of the board member, a leg frame having a back edge hinged to a back end of the board member, a second positioning element disposed between the first positioning elements aligned with but at a distance from the rails, and a hydraulic telescoping rod has a second end hinged to the second positioning element, where each first positioning element has a front pin hole and a back pin hole;

a first support member comprising a flat piece for mounting on a wall surface, two first beams are extended oppositely in parallel toward a front direction, two second beams disposed below the first beams extended oppositely in parallel and slantwise upward, two third beams disposed between and aligned with the second beams having their second ends hinged to the leg frame, two fourth beams having their first ends hinged to the second ends of the third beams, respectively, a seat adjacent to the first ends of the fourth beams sitting across the fourth beams, and a sliding pole arranged moveably between the rails, where the first, second, and third beams have a first end hinged to a front side of the flat piece, the telescoping rod has its first end hinged to the seat; and a locking member disposed to the bottom side of the board member between the second positioning element and the rails with its frond end between the rails, where the locking member provides a notch for locking the sliding pole.

2. The multifunctional folding table according to claim 1, wherein, when the multifunctional folding table is fully unfolded, the board member and the first support member are perpendicular to each other; the sliding pole is locked inside the notch of the locking member; and the telescoping rod extends as the leg frame is turned downward so that a front edge rests on the floor.

3. The multifunctional folding table according to claim 2, wherein a ramp is provided on the front end of the locking member; and the sliding pole runs across the ramp and embeds into the notch.

4. The multifunctional folding table according to claim 2, wherein, at least an adjustable stand is disposed along the front edge of the leg frame.

5. The multifunctional folding table according to claim 2, wherein, when the multifunctional folding table is fully unfolded, the telescoping rod is perpendicular to the board member and the first beams.

6. The multifunctional folding table according to claim 5, wherein the first beams have a length smaller than that of the second beams.

7. The multifunctional folding table according to claim 1, wherein the first, second, third, and fourth beams are arranged at intervals and in parallel.

8. The multifunctional folding table according to claim 1, wherein the board member has a rounded front end; and a width of the board member gradually increases from the front end towards a middle section of the board member.

9. A multifunctional folding table, comprising:

a board member comprising, on a bottom side, two first positioning elements arranged oppositely and in parallel along two lateral edges, respectively, two rails extended in parallel from a front end along a front section of the board member, a leg frame having a back edge hinged to a back end of the board member, a second positioning element disposed between the first positioning elements aligned with but at a distance from the rails, and a hydraulic telescoping rod has a second end hinged to the second positioning element, where each first positioning element has a front pin hole and a back pin hole;

a first support member comprising a first flat piece, two first beams are extended oppositely in parallel toward a front direction, two second beams disposed below the first beams extended oppositely in parallel and slantwise upward, two third beams disposed between and aligned with the second beams having their second ends hinged to the leg frame, two fourth beams having their first ends hinged to the second ends of the third beams, respectively, a seat adjacent to the first ends of the fourth beams sitting across the fourth beams, and a sliding pole arranged moveably between the rails, where the first, second, and third beams have a first end hinged to a front side of the first flat piece, the telescoping rod has its first end hinged to the seat;

a second support member comprising a second flat piece for mounting on a wall surface, two sliding rails extended oppositely in parallel toward a front direction, two sliding elements moveably configured on the sliding rails, respectively, and a frame, where the sliding elements are hinged to a middle spot along a top edge and a bottom edge of the frame, respectively, and a front side of the frame is joined to a back side of the first flat piece of the first support member; and a locking member disposed to the bottom side of the board member between the second positioning element and the rails with its frond end between the rails, where the locking member provides a notch for locking the sliding pole;

wherein, to unfold the multifunctional folding table, the frame is pulled and turned towards the front direction, and the first and second support members are perpendicular to each other; to fold the multifunctional folding table, the frame is turned towards the second support member and, through the sliding elements, the frame is pushed backward; and the first and second members become parallel to each other.

10. The multifunctional folding table according to claim 9, wherein, when the multifunctional folding table is fully unfolded, the board member and the first support member are perpendicular to each other; the sliding pole is locked inside the notch of the locking member; and the telescoping rod extends as the leg frame is turned downward so that a front edge rests on the floor.

11. The multifunctional folding table according to claim 10, wherein, at least an adjustable stand is disposed along the front edge of the leg frame.

12. The multifunctional folding table according to claim 10, wherein, at least an adjustable stand is disposed along the front edge of the leg frame.

13. The multifunctional folding table according to claim 10, wherein, when the multifunctional folding table is fully unfolded, the telescoping rod is perpendicular to the board member and the first beams.

14. The multifunctional folding table according to claim 13, wherein the first beams have a length smaller than that of the second beams.

15. The multifunctional folding table according to claim 9, wherein the first, second, third, and fourth beams are arranged at intervals and in parallel.

16. The multifunctional folding table according to claim 9, wherein the board member has a rounded front end; and a width of the board member gradually increases from the front end towards a middle section of the board member.

* * * * *